US005165738A

United States Patent [19]

McCormack

[11] Patent Number: 5,165,738

[45] Date of Patent: Nov. 24, 1992

[54] LATCH ASSEMBLY

[75] Inventor: Edward McCormack, Media, Pa.

[73] Assignee: Southco, Concordville, Pa.

[21] Appl. No.: 809,878

[22] Filed: Dec. 17, 1991

[51] Int. Cl.[5] ..... E05C 5/02

[52] U.S. Cl. ..... 292/67

[58] Field of Search ..... 292/67, 68, 69, 62, 292/65, 57, 64

[56] References Cited

U.S. PATENT DOCUMENTS 3,402,958 9/1968 Barry ..... 292/62

3,907,348 9/1975 Bates et al. ..... 292/241 X 4,556,244 12/1985 Bisbing ..... 292/65

4,583,775 4/1986 Bisbing ..... 292/64

*Primary Examiner*—Richard E. Moore

*Attorney, Agent, or Firm*—Paul & Paul

[57] ABSTRACT

A latch assembly mounts in an aperture formed in a door to releasably secure the door against the frame. The latch assembly includes a cap which is received over a support base for moving an elongated shaft so that a latching pawl connected to the shaft will engage the inside of the frame in a latched position.

23 Claims, 2 Drawing Sheets

LATCH ASSEMBLY

BACKGROUND OF THE INVENTION

1. Field of the Invention

The present invention relates to latching devices for securing a door, panel or the like in a closed position relative to a frame.

2. Brief Description of the Prior Art

Various types of latching devices for use in securing a door, panel or the like in a closed position relative to a frame are known.

Some types are adapted to be mounted along the outer edge of a cabinet door for securing the door in a closed position against the corresponding cabinet frame. A latching pawl is provided extending from a rotatably and axially driven shaft to engage the inside of the cabinet frame for maintaining the latched position of the door. A rotatable handle is included for driving the shaft and, accordingly, to move the latching pawl to the latched position engaging the frame. However, the handle of one such latch which projects outwardly beyond the body of the latch may cause inadvertent latching and unlatching in response to impact forces. In addition, the handle of another such latch which is operable by a tool may prevent use of the device in certain confined areas.

SUMMARY OF THE INVENTION

The present invention provides a latch for mounting in an aperture formed in a door. The latch releasably secures the door against a corresponding frame when the door and the frame are latched together. A support base is provided which is received within the aperture formed in the door. The support base includes an axial opening extending through it for receiving an elongated shaft. Means associated with the elongated shaft is also provided which is movable with the movement of the elongated shaft for engaging the frame. A cam is provided associated with the elongated shaft and contained within the support base. A cap is also included which is adapted to be received over one end of the support base. Means are provided between the cap and the cam for rotating the cam with rotation of the cap.

Preferably, means are provided between the cap and the shaft for biasing the shaft axially downward. Further, means between the cam and the shaft are provided for imparting either rotational or axial movement to the shaft. Means between the support base and the shaft are provided for limiting the rotational and axial movements of the shaft so that upon rotation of the cap in a first direction, the means associated with the shaft is moved rotationally and then axially to engage the frame in a latched position. Additionally, upon rotation of the cap in a second direction, the means associated with the shaft is moved axially and then rotationally into an unlatched position to allow opening of the door.

Advantageously, the present invention provides a latch assembly in which the handle does not project outwardly beyond the body of the latch.

It is a further advantage of the present invention to provide a latch assembly in which the latching action is accomplished manually by a single turning motion.

DETAILED DESCRIPTION

Figure 1:
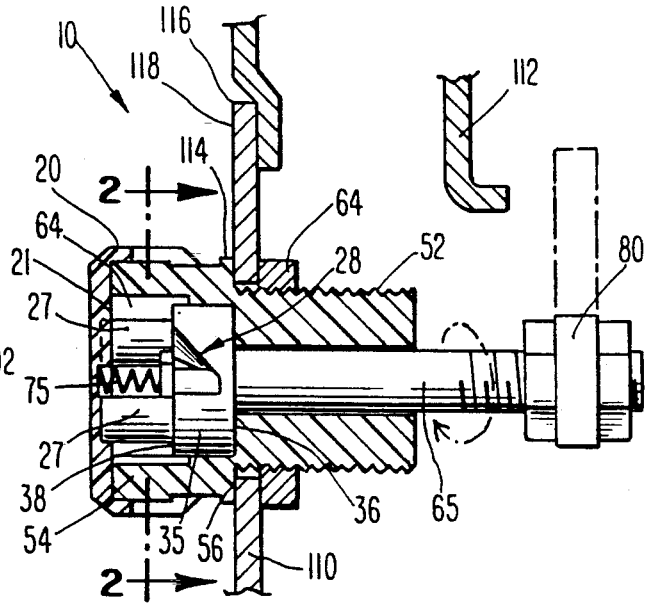
FIG. 1 is a sectional elevational view of a first latch assembly according to the present invention shown mounted in a door for securing the door to a frame, the door being shown in a closed position and the latch assembly being shown in an unlatched position.

Referring now to the drawings in detail, wherein like reference numerals indicate like elements throughout the several views, there is shown in the sectional elevational view of FIG. 1 a latch assembly 10 of the present invention mounted in a door 110. Preferably, the latch assembly 10 according to the present invention is adapted to secure the door 110 of a cabinet (not shown) against a corresponding cabinet frame 112. However, the latch assembly 10 can be used in other applications as well for this purpose, without departing from the broad inventive concepts thereof. The Latch Assembly 10 includes a cap 20, a cam 35, a support base, a shaft 65 and a latching pawl 80.

The support base, generally cylindrically in shape, is adapted to be received within an aperture 114 formed proximate an outer edge 116 of the door 110. The support base includes a threaded sleeve section 52 which projects inwardly through the aperture 114, a flat-head flange 56 adjacent the threaded sleeve section 52 which seats squarely against an outer side 118 of the door 110 when the support base is mounted therein, and an outer portion 54 which projects outwardly from the flange 56 away from the door 110. A threaded nut 64 is received by the threaded sleeve section 52 for securing the support base within the door 110.

Figure 2:
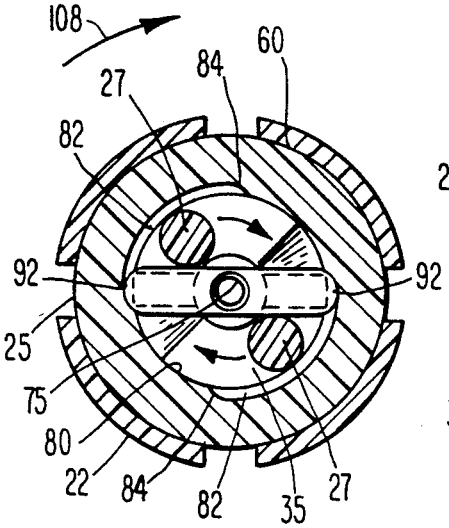
FIG. 2 is a sectional plan view of the latch assembly of FIG. 1 taken along the line 2—2.
Figure 3:
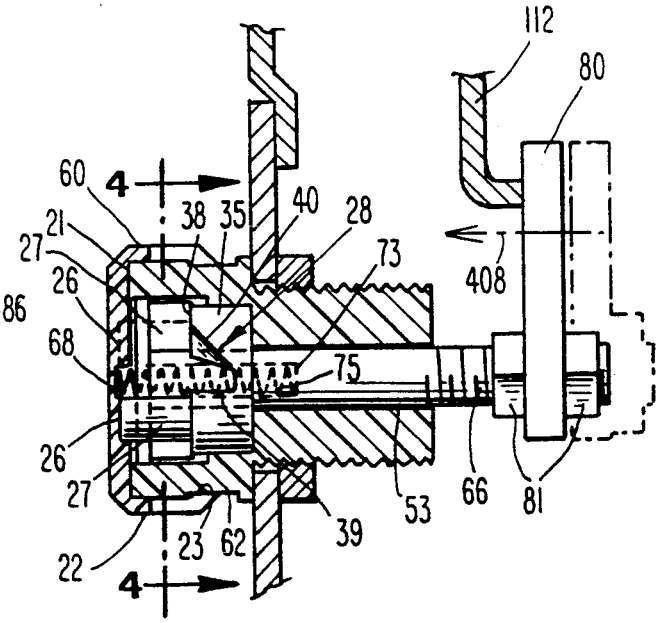
FIG. 3 is a sectional elevational view showing the latch assembly of FIG. 1 in a latched position.

A cap 20, generally cylindrical in shape, is adapted to be received over the outer portion 54 of the support base. The cap 20 includes a substantially flat lower surface 21 which seats squarely against a planar top surface of outer portion 54. As shown in FIGS. 2 and 3, extending perpendicularly inward from the lower surface 21 is an annular seating member 22 which engages an outside surface 60 of outer portion 54. The annular seating member 22 is itself provided with a annular projecting member 23, extending outward from an inner surface thereof, in order that the cap 20 may be snap-fitted within a corresponding annular receptacle 62, formed within the outside surface 60 of outer portion 54. As best seen in the sectional plan view of FIG. 2 taken along the line 2—2 of FIG. 1, the annular seating member 22 also includes a plurality of arcuate cutouts 25 for providing some additional movement of annular seating member 22 out away from the outside surface 60 as the cap 20 is received over the outer portion 54.

As shown in FIGS. 2 and 3, the lower surface 21 of cap 20 further includes a pair of cylindrical bores 26 formed therein for receiving a corresponding pair of cylindrical fingers 27 which project outwardly from the cam 35.

As best seen in FIGS. 1 and 2, the cam 35, substantially cylindrical in shape, is adapted to be received within a substantially cylindrical bore 64 formed within outer portion 54, extending inwardly from the planer top surface. The cam 35 includes a flat lower surface 36 which seats squarely against a flat bottom surface of the bore 64, and a flat upper surface 38 which is provided with a pair of notches (not shown) for receiving the cylindrical fingers 27. As shown in FIGS. 1 and 2, the cap 20 and cam 35 are interconnected by the fingers 27 to provide simultaneous rotational movements thereof.

Figure 4:
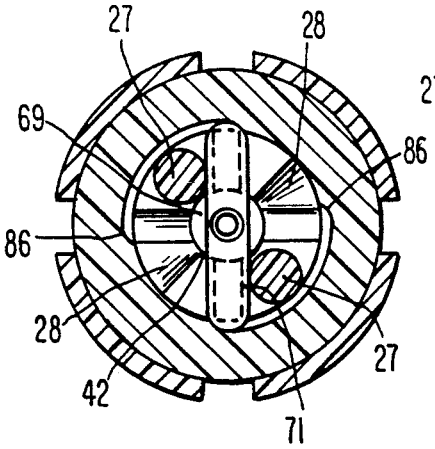
FIG. 4 is a sectional plan view of the latch assembly of FIG. 3 taken along the line 4—4.

As shown in FIGS. 3 and 4, cam 35 also includes a pair of diametrically opposing substantially V-shaped cam slots 28, extending inwardly from the flat upper surface 38 and spaced 180° apart from each other. The cam slots 28 define a pair of opposing axial cam surfaces 39 and a pair of opposing sloping cam surfaces 40. The cam 35 also includes a central cam bore 42 formed therethrough for receiving the elongated shaft 65.

As shown in FIGS. 1 and 3, the elongated shaft 65 is adapted to be received within the central cam bore 42 and through a central sleeve bore 53 formed within the threaded sleeve section 52. The shaft 65 includes a threaded lower end 66 which projects inwardly from the sleeve section 52 for receiving the latching pawl 80, with the position of latching pawl 80 along the shaft 65 being adjustable maintained by a pair of threaded nuts 81. As best seen in FIG. 4, the shaft 65 also includes an upper end 69 which projects outwardly away from the door 110 and within the cam bore 42. Mounted to the upper end 69 is a cross pin 71 which projects laterally in both directions away from the shaft 65 for a purpose described below.

As shown in FIG. 3, the upper end 69 of shaft 65 further includes a center bore 73 formed therein for receiving a first end of a biasing means 75 of the coil compression spring type. The lower surface 21 of the cap 20 is also provided with a center bore 68 for receiving a second end of the biasing means 75 to bias the shaft 65 axially downward for maintaining the cross pin 71 in engagement with the cam 35.

As shown in FIGS. 2 and 4, the outer portion 54 includes an annular inner surface 80, defined by cylindrical bore 64, which is provided with a pair of diametrically oppositely situated arcuate slots 82, spaced 180° apart. The pair of arcuate slots 82 define a pair of axially extending first shoulders 84 spaced 180° apart, a pair of axially extending second shoulders 86 spaced 180° apart, and a pair of laterally extending lower surfaces (not shown), extending from the first shoulders 84 to the second shoulders 86, also spaced 180° apart. Cross pin 71 includes arcuate outer ends 92 which are adapted to be received within the arcuate slots 82.

In FIG. 2, the latch Assembly 10 is shown in a fully unlatched position with the latching pawl 80 rotated away from the cabinet frame 112. When in the unlatched position, the cap 20 is at its fully counterclockwise position, with the two opposing ends of the cross pin 71 projecting through the cam slots 28, engaging the opposing second shoulders 86 of arcuate slots 82. As shown in FIG. 2, latching of the door 110 to the frame 112 occurs as the cap 20 is rotated clockwise in the direction of arrow 108. As previously indicated, rotation of the cap 20 corresponds with rotation of the cam 35. Rotation of cam 35 forces cross pin 71 to rotate within the arcuate slots 82, causing rotation of the shaft 65, until engaging the opposing first shoulders 84. As illustrated in phantom in FIG. 3, the latching pawl 80 is rotated with shaft 65 to a position adjacent, but not engaging the frame 112, when the cross pin 71 engages the first shoulders 84. Continued rotation of cap 20 rotates cam 35, forcing the arcuate outer ends 92 of cross pin 71 to move axially outward within the first shoulders 84, as the inclining sloping cam surfaces 40 are rotated past the cross pin 71. Accordingly, latching pawl 80 is moved axially outward in the direction of arrow 408 with the axial movement of cross pin 71 and shaft 65, engaging the frame 112 in the latched position illustrated in FIG. 3.

The unlatching action of latch assembly 10 is simply the reverse of the latching action which has just been described. On unlatching, counterclockwise rotation of cap 20 rotates cam 35 to allow the cross pin 71 to move axially downward within the second shoulders 86, with the force of biasing means 75, as the declining sloping cam surfaces 40 are rotated past the cross pin 71. Accordingly, latching pawl 80 is moved axially downward on shaft 65, away from the frame 112. Continued rotation of cap 20 rotates the cam 35 which, in turn, rotates the cross pin 71 within the cam slots 28, and accordingly, shaft 65 and latching pawl 80 are rotated away from the frame 112 to allow opening of the door 110.

Figure 5:
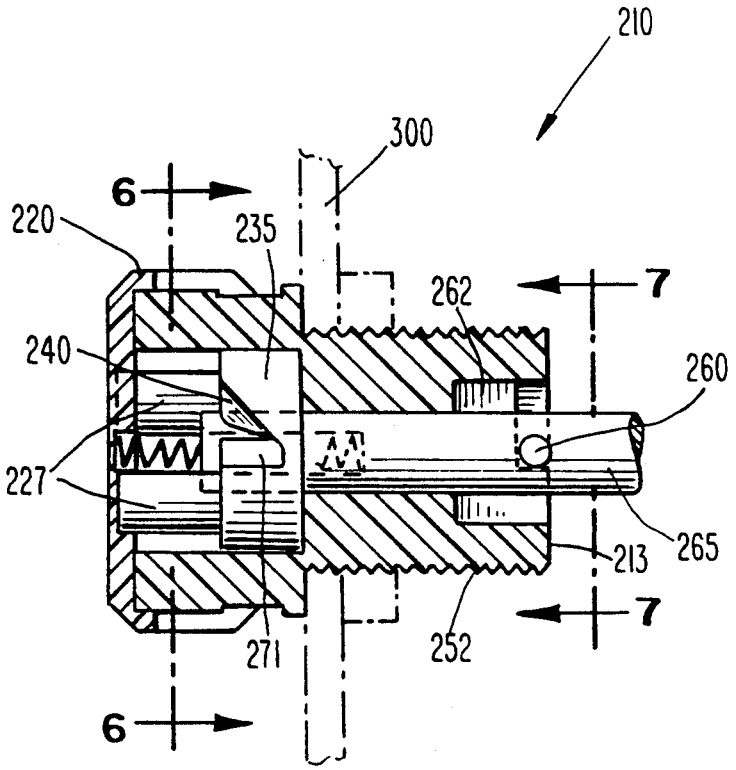
FIG. 5 is a sectional elevational view of a second latch assembly according to the present invention shown mounted in a door.
Figure 6:
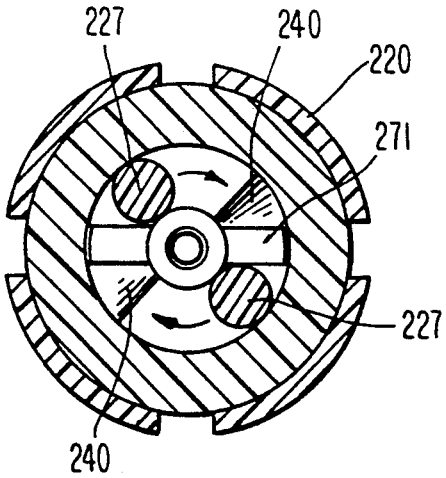
FIG. 6 is a sectional plan view of the latch assembly of FIG. 5 taken along the line 6—6.
Figure 7:
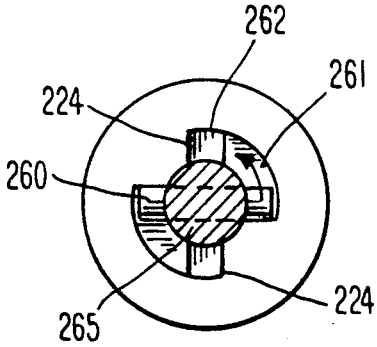
FIG. 7 is a sectional plan view of the latch assembly of FIG. 5 taken along the line 7—7 showing the latch assembly in an unlatched position.
Figure 8:
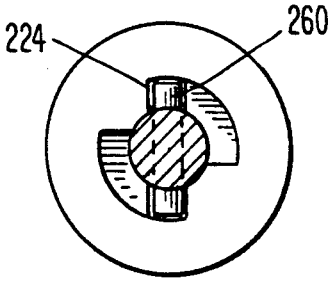
FIG. 8 is a sectional plan view showing the latch assembly of FIG. 7 in a latched position.

In FIG. 5 is shown a sectional elevational view of a second latch assembly 210 according to the present invention mounted in a door 300. The latch assembly 210 comprises a cap 220, a cam 235, a support base, a shaft 265, and a latching pawl (not shown), corresponding to the cap 20, cam 35, support base, shaft 65, and latching pawl 80 of the latch assembly 10. As shown in FIGS. 5 and 7, a pair of diametrically opposing L-shaped slots are provided in an inward end 213 of threaded sleeve section 252. A second pin 260 is connected to the shaft 265 and extends laterally in opposite directions away from shaft 265 within the L-shaped slots. The second pin 260 and L-shaped slots correspond to the arcuate slots 82 and cross pin 71, respectively, in relation to the latch assembly 10. As shown in FIGS. 6 and 7, rotation of the cap 220 will cause rotation of the second pin 260 within the diametrically opposing laterally extending recesses 261 of the L-shaped slots, until engaging the shoulders 224. As shown in FIGS. 5 through 8, the continued rotation of the cap 220 will correspond with rotation of the cam 235, by cylindrical fingers 227, which, in turn, will force a cross pin 271 to follow the inclining sloping cam surfaces 240, and accordingly, the second pin 260 will move axially outward within the diametrically opposing axial extending recesses 262 of the L-shaped slots, forcing shaft 265, and the latching pawl, axially outward for latching against a frame (not shown).

Unlatching of the latch assembly 210 may be accomplished in the reverse of the latching action, corresponding to that described in relation to the latch assembly 10.

While the latch assembly 210 is shown comprising a pair of L-shaped slots within the inward end 213 of threaded sleeve 252, the latch assembly 210 may be provided with a pair of diametrically opposing axial extending slots within inward end 213 for providing axial movements of the latching pawl.

It will be recognized by those skilled in the art that changes may be made by the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

I claim:

1. A latch for mounting adjacent an aperture formed in a door, the latch releasably securing the door against a corresponding frame when the door and the frame are latched together, the latch comprising:

a support base having an opening extending axially therethrough, an elongated shaft extending through the opening in the support base for either rotational or axial movement with respect thereto, means associated with the elongated shaft for movement corresponding with the movement of the elongated shaft for engaging the frame, a cam associated with the elongated shaft and contained within the support base for rotational movement with respect thereto, a cap adapted to be received over one end of the support base for rotational movement, means provided between the cap and the cam for rotating the cam with rotation of the cap, means provided between the cap and the shaft for biasing the shaft axially downward, means provided between the cam and the shaft for imparting either rotational or axial movement to the shaft, and means provided between the support base and the shaft for limiting the rotational and axial movements of the shaft, whereby upon rotation of the cap in a first direction by an operator, the means associated with the shaft is moved rotationally and then axially into a latched position engaging the frame, and upon rotation of the cap in a second direction by an operator, the means associated with the shaft is moved axially and then rotationally into an unlatched position.

2. A latch according to claim 1 wherein the cap includes a generally flat lower surface and an annular seating member extending outward from the lower surface for engaging an outer surface of the support base.

3. A latch according to claim 2 wherein the outer surface of the support base includes an annular receptacle for receiving an annular projecting member extending outward from the annular seating member.

4. A latch according to claim 3 wherein the means between the cap and the cam for rotating the cam with rotation of the cap includes a pair of fingers extending outward from the cam in engagement with the flat lower surface of the cap.

5. A latch according to claim 4 wherein the flat lower surface of the cap is provided with a pair of bores formed therein for receiving the corresponding pair of fingers extending outward from the cam.

6. A latch according to claim 5 wherein the means provided between the cap and the shaft for biasing the shaft axially downward includes a spring engaging the flat lower surface of the cap and an upper end of the shaft.

7. A latch according to claim 6 wherein the spring includes a first end extending within a bore provided in the shaft and a second end extending within a bore provided within the flat lower surface of the cap.

8. A latch according to claim 6 wherein the means provided between the cam and the shaft for imparting either rotational or axial movement to the shaft includes a cross pin associated with the shaft and maintained in engagement against the cam by the means biasing the shaft axially downward.

9. A latch according to claim 8 wherein the cam includes diametrically opposing cam slots for receiving the cross pin.

10. A latch according to claim 9 wherein the means provided between the support base and the shaft for limiting the rotational and axial movements of the shaft includes two diametrically opposing slots provided within the support base in engagement with the cross pin.

11. A latch according to claim 9 wherein the means provided between the support base and the shaft for limiting the rotational and axial movements of the shaft includes a second cross pin associated with the shaft and in engagement with two diametrically opposing laterally extending recesses provided within the support base associated with two diametrically opposing axially extending recesses also provided within the support base.

12. A latch according to claim 9 wherein the means provided between the support base and the shaft for limiting the rotational and axial movements of the shaft includes a second pin associated with the shaft and in an engagement with two diametrically opposing axially extending slots provided within the support base.

13. A latch according to any one of claims 10, 11 and 12 wherein the means associated with the elongated shaft for movement corresponding with the elongated shaft for engaging the cabinet frame includes a latching pawl adjustably associated with and extending outward from the shaft.

14. A latch according to claim 1 wherein the cap includes a generally flat lower surface and an annular seating member extending outward from the lower surface for engaging an outer surface of the support base, wherein the outer surface of the support base includes an annular receptacle for receiving an annular projecting member extending outward from the annular seating member, wherein the means between the cap and the cam for rotating the cam with rotation of the cap includes a pair of fingers extending outward from the cam in engagement with the flat lower surface of the cap, the flat lower surface of the cap is provided with a pair of bores formed therein for receiving the corresponding pair of fingers extending outward from the cam, wherein the means provided between the cap and the shaft for biasing the shaft axially downward includes a spring engaging the flat lower surface of the cap and an upper portion of the shaft, the spring includes a first end extending within a bore provided within the shaft and a second end extending within a bore provided within the flat lower surface of the cap.

15. A latch according to claim 14 wherein the means provided between the cam and the shaft for imparting either rotational or axial movement to the shaft includes a cross pin associated with the shaft and maintained in engagement against the cam by the means biasing the shaft axially downward.

16. A latch according to claim 15 wherein the cam includes diametrically opposing cam slots for receiving the cross pin.

17. A latch according to claim 16 wherein the means provided between the support base and the shaft for limiting the rotational and axial movements of the shaft include two diametrically opposing slots provided within the support base in engagement with the cross pin.

18. A latch according to claim 16 wherein the means provided between the support base and the shaft for limiting the rotational and axial movements of the shaft includes a second pin associated with the shaft and in engagement with two diametrically opposing laterally extending recesses provided within the support base associated with two diametrically opposing axially extending recesses also provided within the support base.

19. A latch according to claim 16 wherein the means provided between the support base and the shaft for limiting the rotational and axial movements of the shaft includes a second pin associated with the shaft and in an engagement with two diametrically opposing axially extending slots provided within the support base.

20. A latch for mounting adjacent an aperture formed in a door, the latch releasably securing the door against a corresponding frame when the door and the frame are latched together, the latch comprising:

a support base having an opening extending axially therethrough, an elongated shaft extending through the opening in the support base for either rotational or axial movement with respect thereto, a cam associated with the elongated shaft and contained within the support base for rotational movement with respect thereto, the cam including diametrically opposing cam slots, a cap adapted to be received over one end of the support base for rotational movement, the cap including a generally flat lower surface and an annular seating member extending outward from the lower surface for engaging an outer surface of the support base, the outer surface of the support base including an annular receptacle for receiving an annular projecting member extending outward from the annular seating member, means provided between the cap and the cam for rotating the cam with rotation of the cap, the means between the cap and the cam for rotating the cam including a pair of fingers extending outward from the cam in engagement with the flat lower surface of the cap, the flat lower surface of the cap including a pair of bores formed therein for receiving the corresponding pair of fingers extending outward from the cam, means provided between the cap and the shaft for biasing the shaft axially downward, the means provided between the cap and the shaft includes a spring engaging the flat lower surface of the cap and an upper portion of the shaft, the spring having a first end extending within a bore provided in the shaft and a second end extending within a bore provided within the flat lower surface of the cap, means provided between the cam and the shaft for imparting either rotational or axial movement to the shaft, the means provided between the cam and the shaft including a cross pin associated with the shaft and maintained in engagement against the cam by the means biasing the shaft axially downward, means associated with the elongated shaft for movement corresponding with movement of the elongated shaft for engaging the cabinet frame, the means associated with the elongated shaft including a latching pawl adjustably associated with and extending outward from the shaft, means provided between the support base and the shaft for limiting the rotational and axial movements of the shaft, whereby upon rotation of the cap in first direction by an operator, the latching pawl is moved rotationally and then axially into a latched position engaging the frame, and upon rotation of the latching pawl in a second direction by an operator, the latching pawl is moved axially and then rotationally into an unlatched position.

21. A latch according to claim 20 wherein the means provided between the support base and the shaft for limiting the rotational and axial movements of the shaft includes two diametrically opposing slots provided within the support base in engagement with the cross pin, each slot defining a pair of axially extending shoulders.

22. A latch according to claim 20 wherein the means provided between the support base and the shaft for limiting the rotational and axial movements of the shaft includes a second pin associated with the shaft and in engagement with two diametrically opposing laterally extending recesses provided within the support base associated with two diametrically opposing axially extending recesses also provided within the support base.

23. A latch according to claim 20 wherein the means provided between the support base and the shaft for limiting the rotational and axial movements of the shaft includes a second pin associated with the shaft and in engagement with two diametrically opposing axially extending slots provided within the support base.

* * * * *